United States Patent [19]

Nussbaum

[11] Patent Number: 4,646,966

[45] Date of Patent: Mar. 3, 1987

[54] PERSONALIZED AIR CONDITIONING

[75] Inventor: Otto J. Nussbaum, Newtown, Pa.

[73] Assignee: Argon Corporation, Philadelphia, Pa.

[21] Appl. No.: 743,384

[22] Filed: Jun. 11, 1985

[51] Int. Cl.[4] ..... F24F 7/00

[52] U.S. Cl. ..... 237/49; 98/31; 98/38.9; 236/49

[58] Field of Search ..... 236/49, 13, 38; 98/31, 98/38.1, 38.6, 38.9; 165/22, 54; 237/49

[56] References Cited

U.S. PATENT DOCUMENTS

| | | | |
|---|---|---|---|
| 1,936,914 | 11/1933 | Pitt | 165/54 X |
| 2,434,847 | 1/1948 | Hagen | 98/38.9 |
| 2,633,070 | 3/1953 | Gillham | 165/54 X |
| 2,681,182 | 6/1954 | McGroth | 165/22 X |
| 2,877,990 | 3/1959 | Goemann | 165/48.1 |
| 3,172,463 | 3/1965 | Bowman | 236/38 X |
| 3,929,285 | 12/1975 | Dougherty, Jr. | 236/13 |
| 3,951,205 | 4/1976 | Zilbermann | 165/22 X |
| 3,985,295 | 10/1976 | Monninger | 236/38 |
| 4,135,440 | 1/1979 | Schmidt et al. | 98/31 |

*Primary Examiner*—William E. Wayner
*Attorney, Agent, or Firm*—Robert K. Youtie

[57] ABSTRACT

An air conditioning system in a building space having side walls and a hollow horizontal partition or wall which provides a plenum for preconditioned air at substantially atmospheric pressure, a hollow column extending from the horizontal partition for receiving conditioned air, air outlets in the column for distributing air to the immediate environs of the column, a fan in the column for moving air from the plenum into the column and through the air outlets, and a selectably variable fan control in the building space.

9 Claims, 5 Drawing Figures

PERSONALIZED AIR CONDITIONING

BACKGROUND OF THE INVENTION

In the field of commercial heating and air conditioning, there are known to be problems causing discomfort to the occupants, inefficiencies resulting in excessive cost to the building operator, and inconveniences in operation and control of present systems.

For example, central building control of temperature, air flow, humidity, and the like, or even individual room control usually leaves some persons in the building or room uncomfortable or dissatisfied with their work environment. Also, different locations in a building, or even in a single room, are not equally cooled or heated, giving rise to complaints about discomfort and resulting in loss of productivity.

Further, conventional air conditioning systems generally require expensive duct work, usually in floors or ceilings, or both, and cause unnecessary heating and cooling of much unused space, particularly that above the head level of workers, for example the upper four feet of space in a room having a twelve foot ceiling.

Also, in conventional heating and air conditioning systems, it has not been economically feasible to incorporate lighting, plumbing and other utilities.

| U.S. PAT. NO. | PATENTEE |
|---|---|
| 2,877,990 | GOEMANN |
| 2,971,747 | YOUNG |
| 3,354,946 | DEAN, JR. |
| 3,516,347 | MAY |
| 3,690,370 | PIPER |
| 3,693,705 | STOTZ |
| 3,908,751 | SHEPPARD, JR. |
| 4,135,440 | SCHMIDT ET AL. |
| 4,353,411 | HARTER ET AL. |
| 4,425,839 | STULL |
| **SOUTH AFRICAN PATENT APPLN. NO.** | **APPLICANT** |
| 81/5869 (filed August 25, 1981) | Ventline Manufacturing (PTY) Limited |

SUMMARY OF THE INVENTION

Accordingly, it is an important object of the present invention to provide an environmental control system for commercial and industrial buildings which overcomes the above mentioned difficulties, effects considerable savings in initial capital expenditure by utilizing hollow horizontal walls or floors as plenums at atmospheric pressure to eliminate expensive ducting; which affords to small groups or single persons individually selected and controlled conditions of air, direction and rate of flow to greatly enhance worker satisfaction and resultant productivity.

The present invention further contemplates substantial savings in costs of changing work spaces as air ducts are eliminated, together with the need for any rearrangement, extension, connection etc. Moreover, the provision of conventional utilities, such as electricity, and change of such utilities is greatly simplified, and the cost reduced. The addition of more recently employed utilities, such as fiber optics, computer cables, and the like, may be included in both new and existing building structures at substantial savings in costs.

Other objects of the present invention will become apparent upon reading the following specification and referring to the accompanying drawings, which form a material part of this disclosure.

The invention accordingly consists in the features of construction, combinations of elements, and arrangement of parts, which will be exemplified in the construction hereinafter described, and of which the scope will be indicated by the appended claims.

DESCRIPTION OF THE PREFERRED EMBODIMENTS

Figure 2:
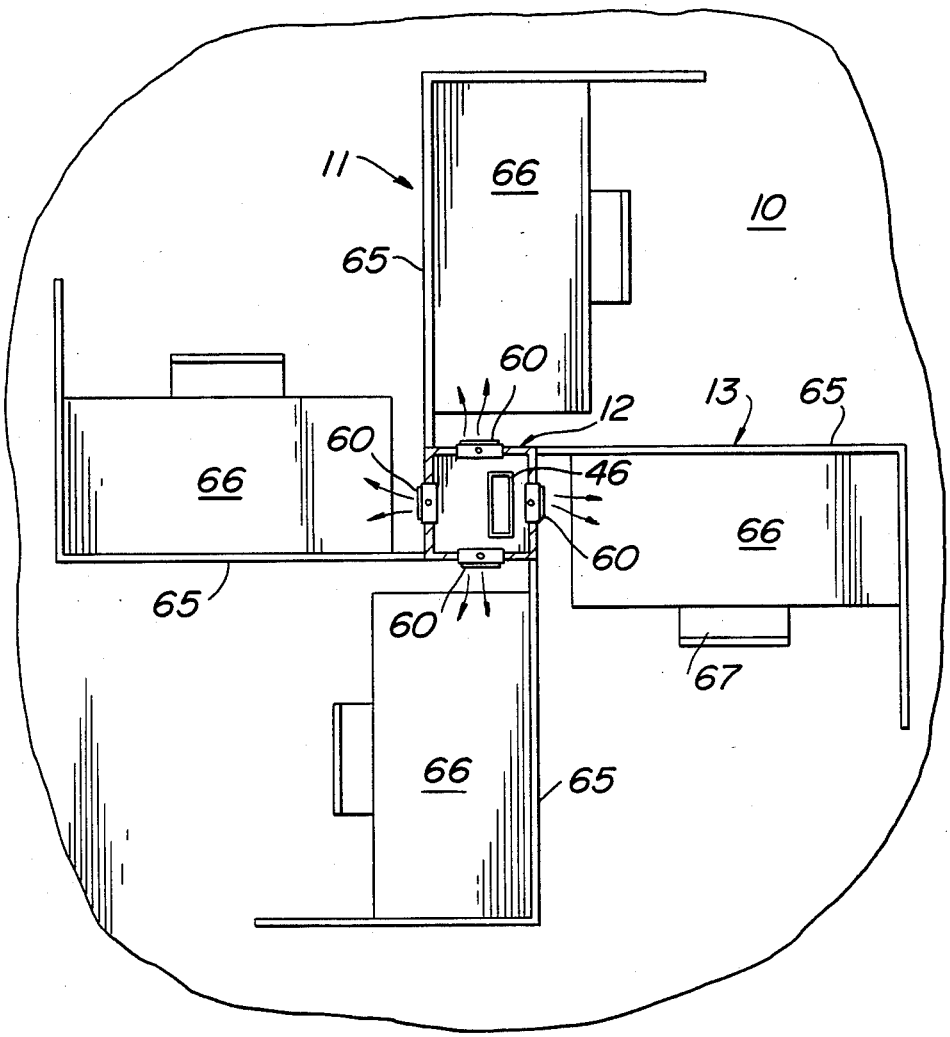
FIG. 2 is a horizontal sectional view taken generally along the line 2—2 of FIG. 1.

Referring now more particularly to the drawings, and specifically to FIG. 2 thereof, a building floor is there generally designated 10, on which is installed a work station 11 including a central upright air column or passageway 12, and a plurality of individual work places, counters or desks 13 extending radially outwardly from the central column or passageway 12.

Figure 1:
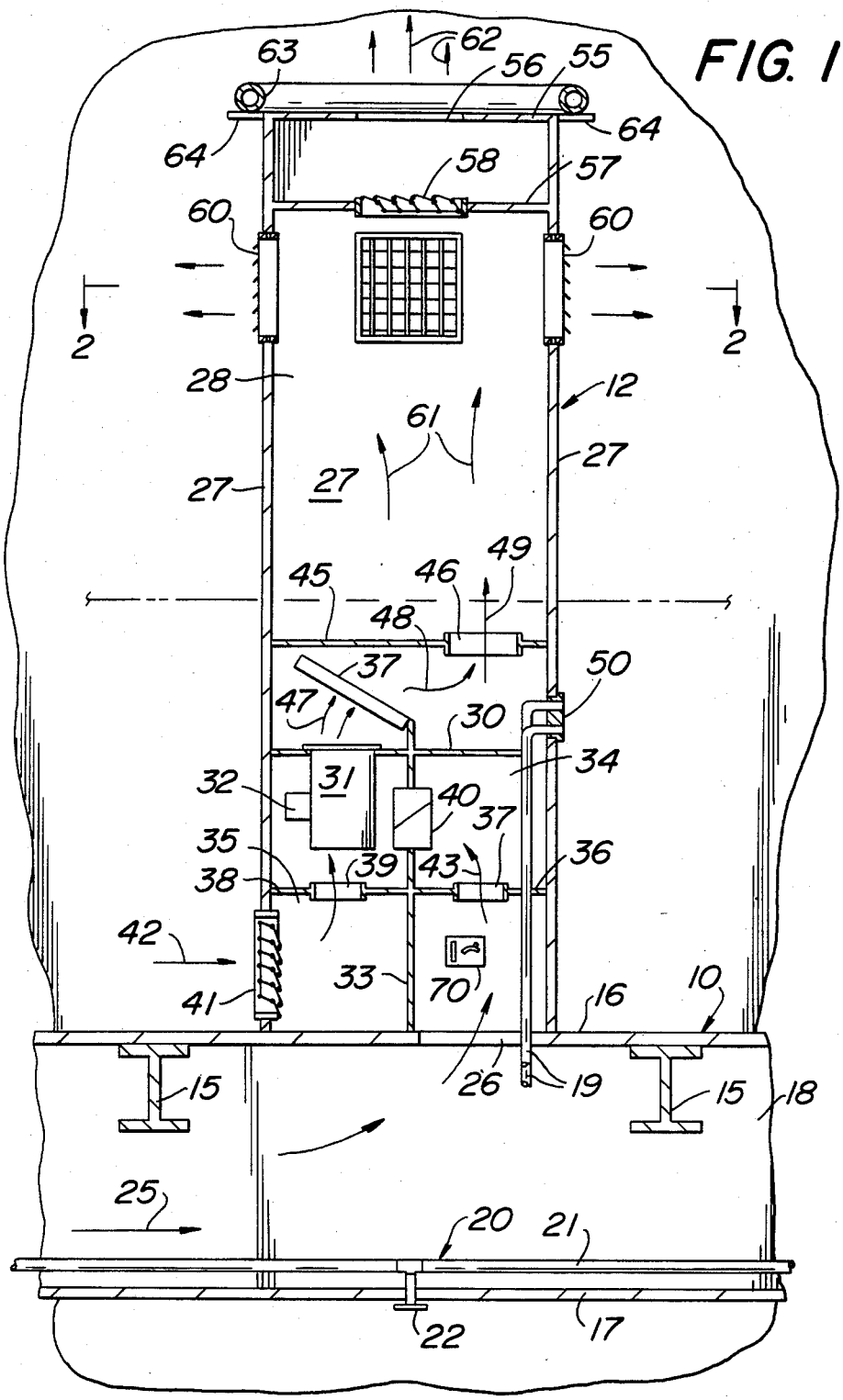
FIG. 1 is a sectional elevational view showing a personalized environmental control station in accordance with the teachings of the present invention.

The column or passageway 12 is best seen in FIG. 1 and may extend transversely of or upstand from the floor 10. The floor 10 may include support structure, such as beams 15 which carry an upper horizontal surface or raised floor 16. A lower horizontal surface or floor 17 is located in spaced relation from the raised floor 16 and combines with the latter to define a generally horizontally extending interior hollow or space 18.

As will appear more fully hereinafter, the substantial space of interior hollow 18 need not be obstructed by air ducts, or the like, and may provide an efficient plenum for or reservoir of conditioned air. If desired, return air ducts and various utilities may be supplied through the hollow 18 of horizontal wall 10, such as electric power, electronic and optical communications, water, and others. Utility conduits, as desired, are shown typically at 19. A sprinkler system 20 may include piping 21 in the hollow 18 and sprinkler heads 22 extending from the piping through the floor 17.

A supply of conditioned air communicates with the plenum 18, flowing as indicted by arrows 25. The conditioned air 25 is advantageously at substantially atmospheric pressure in the plenum 18 to minimize air moving energy requirements and substantially avoid leakage to and from the plenum without expensive sealing of the plenum.

The upper layer or raised floor 16 of floor 10 is provided with one or more through openings as at 26, which openings may be provided with closures for nonuse.

Over a floor opening 26 is located the upstanding passageway or column 12, which may be of generally polygonal cross section, say constituted of a plurality of generally upright side walls 27 combining to define therebetween the interior hollow 28 of the column or passageway 12.

In the illustrated embodiment there are four upstanding side walls 27, but the number may vary if desired, and the column or passageway 12 need not be of polygonal horizontal cross section, but may be constituted of a cylinder of circular cross section, or other suitable configuration, as desired.

Interiorly of the column or passageway 12, adjacent to and spaced from the horizontal wall or floor 10, there may be provided a horizontal partition 30 extending transversely across the interior hollow 27 of the column. Mounted by the partition or interior column wall 30 may be an air mover or fan 31 driven by suitable motive means 32, such as a motor, to displace air from the lower side of wall or partition 30 adjacent to floor 10 to the upper side of the wall or partition 30. In addition, a partition or wall 33 may extend longitudinally within the interior hollow 28 of the column 12, generally vertically between the partition 30 and the raised floor 16. The upright partition or bulkhead 33 subdivides the space between horizontal partition 30 and raised floor 16 into a pair of compartments 34 and 35. The compartment 34 communicates through the floor opening 26 with the plenum 18, while the compartment 35 communicates through the air mover 31 with the interior hollow 28 above the partition 30.

The compartment 34 may be subdivided by a vertically intermediate, generally horizontal partition 36 having a through opening 37; and similarly the compartment 35 may be vertically subdivided by a generally horizontal partition 38 having a through opening 39.

Located in the upright partition or bulkhead 33, for communication between the compartments 34 and 35, is an air proportioning device or valve 40 for passing conditioned air from the compartment 34 to the air mover 31 at a desired rate. Communicating between the interior of compartment 35 and the immediate environs, being the room space, is a one way air valve or relief damper 41. By the backdraft or relief damper 41, room air may pass in the direction of arrow 42 into compartment 35 for mixture with conditioned air passing in the direction of arrow 43 and through air proportioning valve 40. This mixture of air may be passed by the fan or blower 31 through and upwardly beyond the partition 30. Valve 40 is controlled by a sensor in chamber 34, which tends to close valve 40 as the air temperature at 43 drops. When valve 40 reaches its fully closed position, only induced air from 42 will enter the air mover through relief damper 41.

Spaced over the generally horizontal partition 30 is an additional generally horizontal partition 45 having a through opening or aperture 46 spaced laterally from the air mover 31. An air heater or heating coil 44 may be interposed between the partitions 30 and 45, and between the fan 31 and aperture 46 for heating air passing therebetween. That is, air passing in the direction of arrows 47 from air mover 31 passes through heater 44 and thence in the direction of arrows 48 and 49 into the upper interior hollow 28 of the column or passageway 12. The air proportioning device 40 is controlled to mix room air 42 and conditioned air 43 in desired proportions; air mover 31 being suitably controlled, as through speed controlled motor 32, to move the air mixture at a desired rate; and heater 37 being suitably controlled to impart a desired heating influence on the air being moved.

The utilities 19 may extend upwardly through partition 30 and be provided with suitable connector means 50 in a column wall 27 for convenient access from exteriorly of the column.

The upper end of column or passageway 12 remote from the floor 10 may be provided with an end wall 55, preferably having a through opening 56. Adjacent to and spaced below the upper column end wall 55, interiorly of the column hollow 28, there may be provided a generally horizontal internal wall or partition 57 having mounted therein a relief damper or diffuser 58. That is, the horizontal partition or wall 57 is spaced over the horizontal wall or partition 45, for passage of excess air 49 from the hollow 28 of column 12 through relief damper or diffuser 58, upon sufficient pressure difference on opposite sides of the relief damper or diffuser when outlets 60 approach their fully closed position.

A plurality of air outlets or vents 60 are provided in the walls 27 of column or passageway 12, spaced between the partitions 45 and 57. The air outlets or vents 60 are advantageously adjustable both volumetrically and directionally, such as used for ventilating passenger vehicles. In practice, each wall 27 of the column 12 may be provided with an adjustable vent 60. When excess air is fed into the hollow 28 between partition 45 and 57, as at 61, for exit through the vents 60, the excess may pass upwardly and outwardly through the relief damper 58 and opening 56, as at 62. At the upper end or top wall 55 of column 12 there may be mounted an illumination means or lamp 63, say an annular lamp seated on arms 64 outstanding from the column, for dispensing light upwardly and downwardly to the surrounding workplaces. Cool air moving over the lamps reduces their operating temperature. This helps the lamps work more efficiently and lengthens their useful life.

As shown in FIG. 2, each work place may include a generally upright separator or wall 65 extending generally radially outwardly from the column or passageway 12. More specifically, each separator or wall 65 extends generally radially outwardly from the passageway or column 12 at a location thereon spaced between an adjacent pair of air outlets 60. A work bench or desk 66 may be located at suitable working height close to each separator 65, and may be provided with its respective seat or stool 67. Thus, as best seen in FIG. 2, the space between each adjacent pair of generally radially extending separators 65 define an individual work space, and each air outlet or vent 60 is associated with a respective work space for dispensing conditioned air at the desired rate and in the desired direction, as selectively and personally controlled by the occupant of the work space.

A thermostatic sensor is shown at 70, which may be located in the supply air stream 43, and may thermostatically control operation of the air proportioner 40, air mover 31 and heater 37. These components may be individually controlled; or, preferrably the control of these components may be automatic and located remotely from the work station, for example at a central microprocessor, to allow the individuals to provide their own desired quantity and direction of conditioned air through their respective air outlets 60. Obviously, the overall room temperature, say in hot weather conditions, need not be so cool as the air mixture supplied directly to the work places, to effect substantial savings in cooling load. Cold weather operation may effect similar savings in the total heating load.

Figure 3:
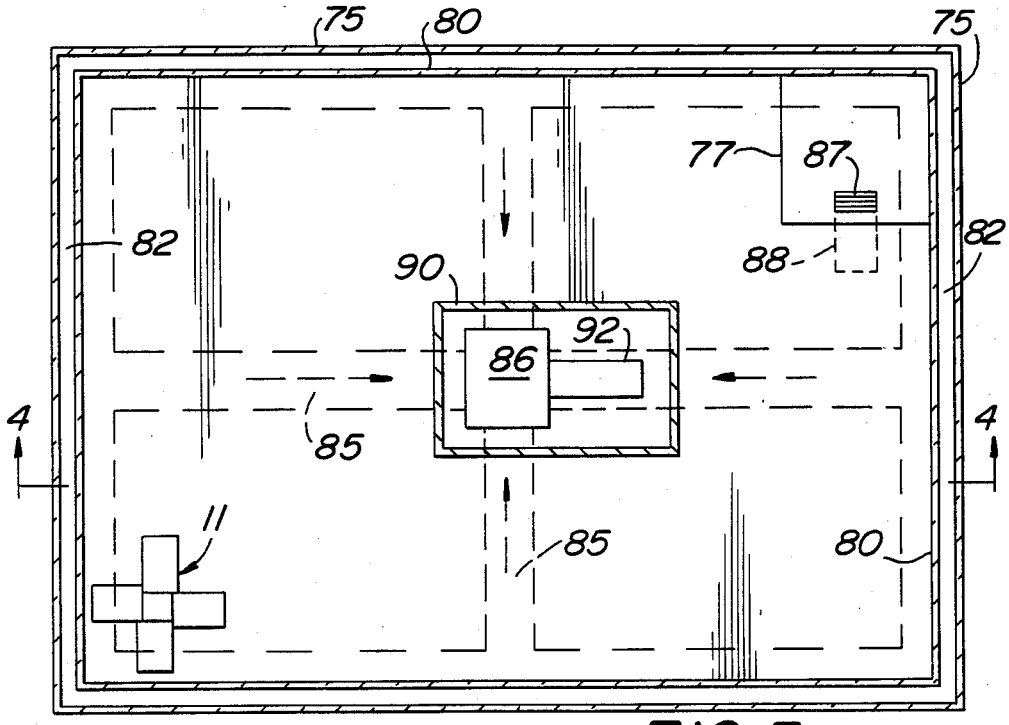
FIG. 3 is a plan view showing a typical building floor employing the personalized air conditioning of the present invention.
Figure 4:
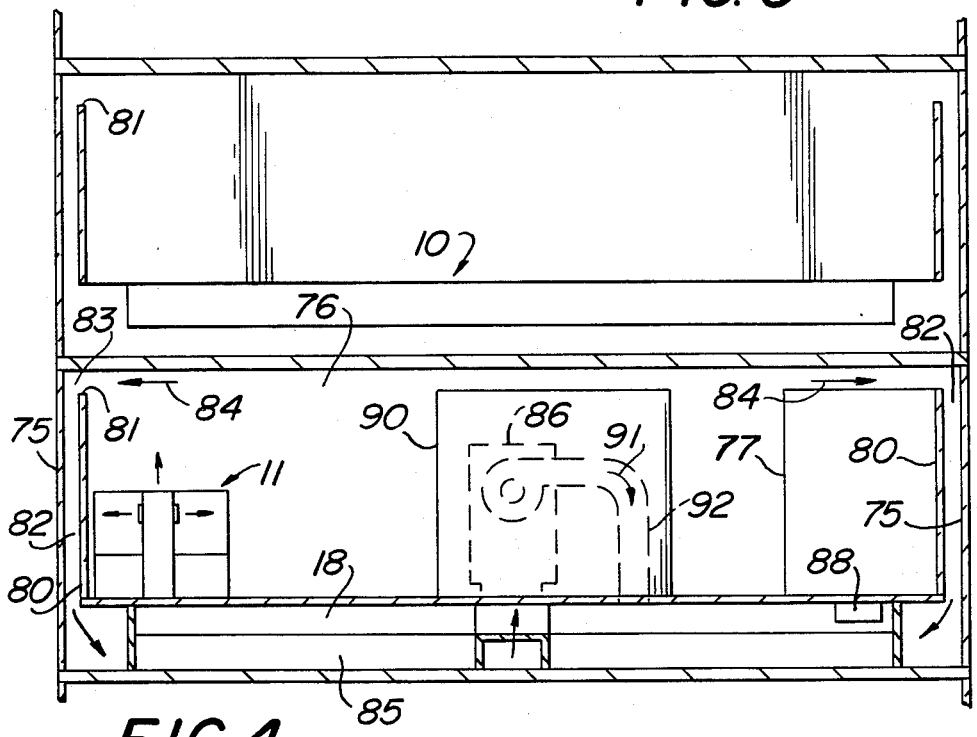
FIG. 4 is a sectional elevational view taken generally along the line 4—4 of FIG. 3.

Referring now to FIGS. 3 and 4, the plan view of FIG. 3 illustrates a horizontal partition or floor 10 and circumferential upright outer walls 75 bounding the room space 76. A single work station 11 is shown in one corner of the room space 76, but any desired number of work stations may be selected and located as desired. A private office 77 is shown in another corner of the space 76, but may be located elsewhere, as desired.

Extending along and spaced inwardly from the outer walls 75 are inner walls 80, which upstand from the horizontal wall 10 to an upper bounding edge 81, adjacent to and spaced below the next adjacent upper floor 10. This is best seen in FIG. 4. Thus, the inner walls 80 combine with the outer walls 75 to define an interwall space substantially surrounding the room space 76, and interposed between the room space and the exterior of the outer wall 75. Such interwall space may be designated 82. The spacing of the upper edge 81 of inner wall 80 below the next upper horizontal partition 10, as at 83, defines an upper fluid communication means for passing return air or removing room air, as in the direction of arrow 84, to the interwall space 82.

The lower region of the interwall space 82 may be open to one or more return air ducts, as at 85. The ducts 85 may pass through the plenum 18 and not directly communicate with the plenum, but communicate with an air conditioning unit 86, which in turn communicates and passes conditioned air to the plenum. The return air ducts 85 in the plenum 18 thus define a lower fluid communication means for removing air from the interwall space 82 for treatment and return to the plenum 18. Thus, return air passes downward through the interwall space 82 to define an insulating air curtain interposed between the room space 76 and the building exterior. By this air curtain heat gains or losses between the room space and building exterior are minimized for improved cooling capacity and energy efficiency. Further, the interwall space 82 may be utilized for blinds, or other accessories, and advantageously the inner walls 80 are transparent for light permeability and moveably mounted, as on tracks, for convenient access to the interwall space. The lower fluid communication means or return air ducts 85 may be provided with suitable dampers or other flow control means communicating with the air supply plenum 18 to enable adjusting the supply air temperature, if desired.

In the illustrated embodiment there is provided a central core 90 in the room space 76, including the air unit 86 for passing conditioned air, as at 91, through conduit 92 to the plenum. The central core 90 may house various utilities also, if desired. However, the air unit 86 need not be located in the room space 76, but may be located elsewhere, as desired.

The office 77 may be private with walls 78 and 79 from floor to ceiling, or otherwise as desired. A floor supply outlet 87 may be located in the office 77 and communicate with the plenum 18, as by a fan-air terminal 88 in the same way as column or passageway 12.

Figure 5:
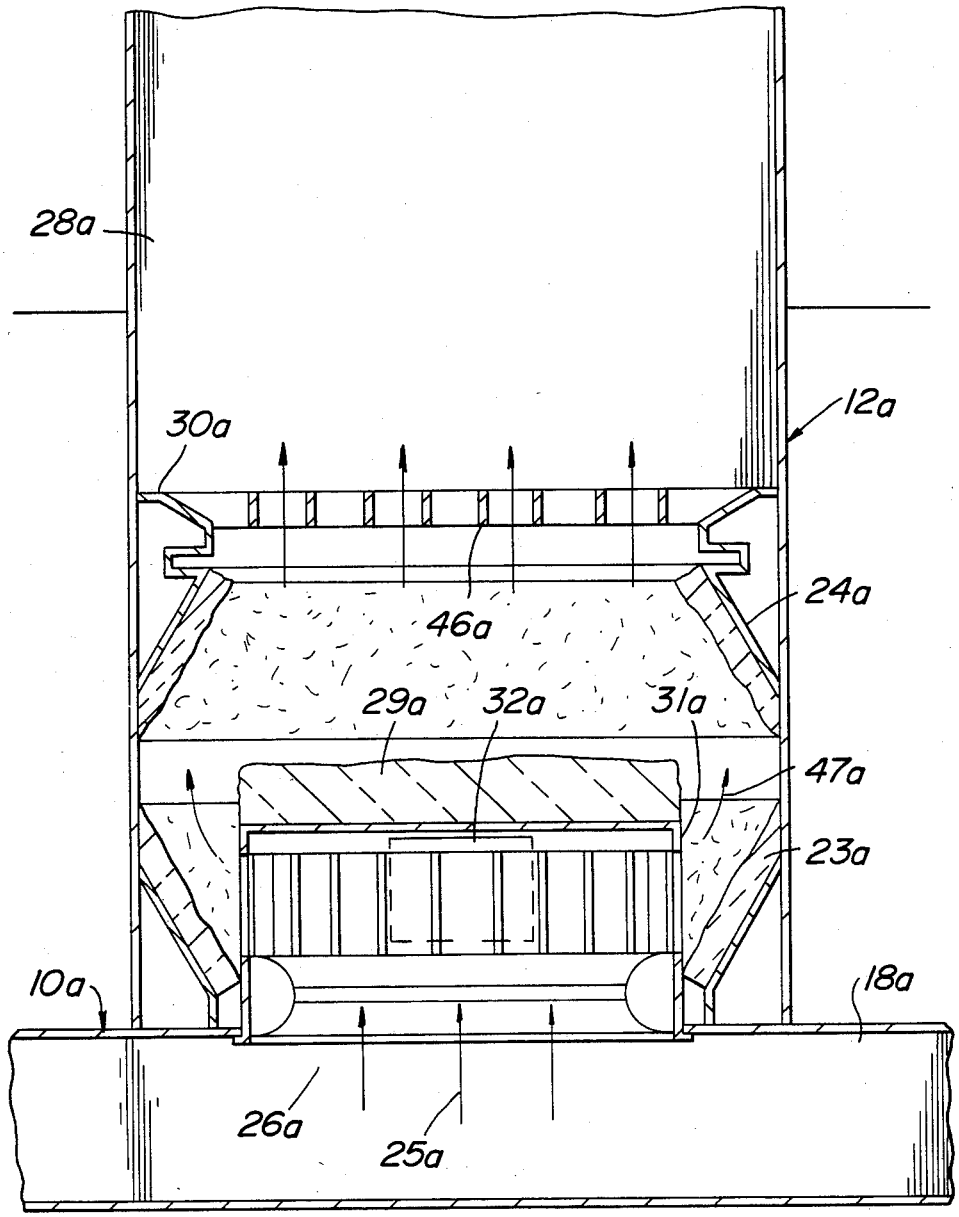
FIG. 5 is a sectional elevational view showing a modified embodiment of the lower region of the station of FIG. 1.

A slightly modified embodiment is shown in FIG. 5, wherein a passageway or column **12*a* on a floor 10*a* has its hollow interior 28*a* communicating downwardly through a floor opening 26*a* with a floor hollow or plenum 18*a***.

An air mover, fan or blower **31*a* is mounted over the floor opening 26*a*, and may be driven by suitable motive means, such as a motor 32*a*. The air mover or blower 31*a* may be axial, centrifugal, or mixed flow type, having an inlet for receiving plenum air, as at 25*a*; and the air may emerge peripherally or axially, or both, from the air mover or fan 31*a*, as at 47*a***.

Surrounding the air mover or blower **31*a* may be upwardly diverging walls 23*a* for directing the fan exiting air 47*a* generally upwardly; and, upwardly converging or tapering walls 24*a* may be provided interiorly of the column 12*a* directing air to the horizontal wall opening 46*a*. The walls 23*a* and 24*a* may advantageously be fabricated of sound insulating material; and, a layer of sound insulating material 29*a* may be provided on top of the air mover 31*a***, all for minimizing noise.

From the foregoing it is seen that the present invention provides a personalized air conditioning system which is extremely simple in construction to effect substantial savings in initial and continuing costs, being highly versatile for use with changing work place requirements, enhancing the comfort of individuals having differing comfort requirements, for increased work place efficiency.

Although the present invention has been described in some detail by way of illustration and example for purposes of clarity of understanding, it is understood that certain changes and modifications may be made within the spirit of the invention.

What is claimed is:

1. In a commercial building, the combination comprising generally circumferential upright walls, generally horizontal partitions separated vertically from each other and extending between said upright walls, said upright walls and a pair of adjacent horizontal partitions combining to define room space, at least one of said horizontal partitions being substantially hollow to define therein a plenum for preconditioned air, a source of preconditioned air associated with said building and communicating with said plenum at a pressure approximately just sufficiently above atmospheric pressure to overcome gravity and friction and maintain preconditioned air in said plenum, a passageway extending from said one horizontal partition and having a hollow interior communicating into said air movement means and plenum for forcibly drawing room air into said passageway interior at a thermostatically controlled rate, and separate fluid courses communicating between said air movement means and each of said plenum and air inlet means for respectively conducting preconditioned air and room air, valve means in one of said courses, and selectable valve control means in said immediate environs for controlling the proportions of mixed room and preconditioned air exiting said outlet means.

2. The combination according to claim 1, in combination with heating means extending within the interior of said passageway between said air movement means and air outlet, and personally selectable heating means control in said immediate environs.

3. The combination according to claim 1, in combination with utility conduits extending through said plenum and into said passageway interior, and utility connections attached to said conduits for access in said immediate environs.

4. The combination according to claim 1, said air outlet facing transversely of said passageway and personally selectively adjustable volumetrically and directionally into said immediate environs.

5. The combination according to claim 4, in combination with additional air outlets facing transversely of said passageway away from said first mentioned outlet and each other, said additional air outlets being personally adjustable volumetrically and directionally by respective persons in said immediate environs, for accomodation of a single passageway to several persons.

6. The combination according to claim 5, said first mentioned and additional air outlets being at an elevation approximating head height of working persons.

7. The combination according to claim 5, in combination with a relief damper in said passageway communicating longitudinally from one end of said passageway interior remote from said air movement means for communication exteriorly of said passageway.

8. The combination according to claim 7, said additional air outlets being located at an elevation generally above the head height of working persons.

9. The combination according to claim 5, in combination with a plurality of upstanding separators each extending exteriorly from a location on said passageway between an adjacent pair of said first mentioned and additional air outlets, an adjacent pair of said separators defining therebetween a work space.

* * * * *